US005931063A

United States Patent [19]

Kuo

[11] Patent Number: 5,931,063

[45] Date of Patent: Aug. 3, 1999

[54] WRENCH TOOL

[76] Inventor: Ying Hong Kuo, 4F, No. 37, Lane 113, Tunghu Road, Neihu Dist., Taipei, Taiwan

[21] Appl. No.: 09/009,406

[22] Filed: Jan. 20, 1998

[51] Int. Cl.[6] ..... B65B 13/02

[52] U.S. Cl. ..... 81/119; 81/186; 81/DIG. 8

[58] Field of Search ..... 81/119, 177.2, 81/186, DIG. 8

[56] References Cited

U.S. PATENT DOCUMENTS

| | | | |
|---|---|---|---|
| 120,304 | 10/1871 | McBride | 81/119 |
| D. 167,245 | 7/1952 | Anderson | 81/119 |
| 342,128 | 5/1886 | Parker | 81/119 |
| 1,568,442 | 1/1926 | Carver | 81/119 |
| 4,517,862 | 5/1985 | Garcia | 81/119 |

FOREIGN PATENT DOCUMENTS

| | | | |
|---|---|---|---|
| 19153 | 9/1898 | United Kingdom | 81/119 |

*Primary Examiner*—David A. Scherbel
*Assistant Examiner*—Lee Wilson
*Attorney, Agent, or Firm*—Charles E. Baxley, Esq.

[57] ABSTRACT

A wrench tool includes a member having an engaging opening formed in one end for engaging with fasteners to be driven. The other end of the member includes an orifice parallel to the longitudinal axis and the other orifice perpendicular to the previous orifice, for allowing the orifices to engage with different tool members. The member includes a pair of tapered surface having a number pairs of opposite engaging surfaces for engaging with fasteners of different sizes. A coupler is pivotally coupled to the member and the orifices are formed in the coupler.

3 Claims, 6 Drawing Sheets

WRENCH TOOL

BACKGROUND OF THE INVENTION

1. Field of the Invention

The present invention relates to a wrench, and more particularly to a wrench tool for engaging with the other extensions or the other wrenches.

2. Description of the Prior Art

Typical wrenches comprise a head solidly secured to one end of a handle. The head may not be provided for engaging with the other wrenches or extensions.

The present invention has arisen to mitigate and/or obviate the afore-described disadvantages of the conventional wrenches.

SUMMARY OF THE INVENTION

The primary objective of the present invention is to provide a wrench tool including two orifices perpendicular to each other for engaging with the other wrench or extension and for allowing the other wrench or the extension to drive the wrench tool.

In accordance with one aspect of the invention, there is provided a wrench tool comprising a wrench body including a first end having an engaging opening for engaging with fasteners to be driven, and the wrench body including a longitudinal axis and including a second end having a first orifice parallel to the longitudinal axis and having a second orifice perpendicular to the first orifice, for allowing the first orifice and the second orifice to engage with different tool members.

The first end of the wrench body includes a pair of jaws for defining the engaging opening between the jaws, the jaws include a pair of tapered surface arranged in V-shape and having a plurality pairs of opposite engaging surfaces for engaging with fasteners of different sizes. The second end of the wrench body includes a coupler pivotally coupled to the first end of the wrench body at a pivot shaft, the first orifice and the second orifice are formed in the coupler for engaging with the different tool members.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 3:
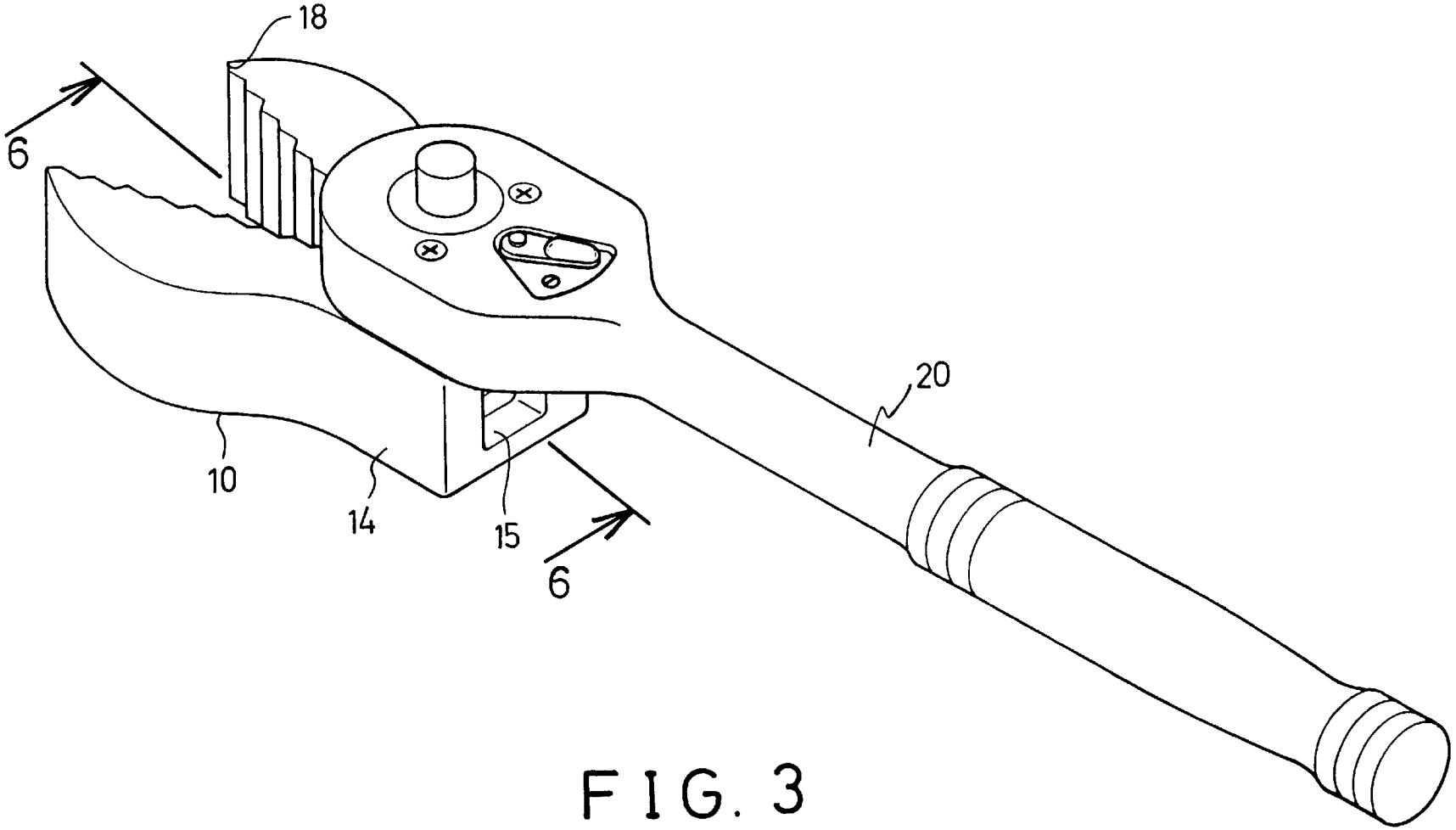
FIGS. 3 and 4 are perspective views illustrating the two applications of the wrench tool.
Figure 4:
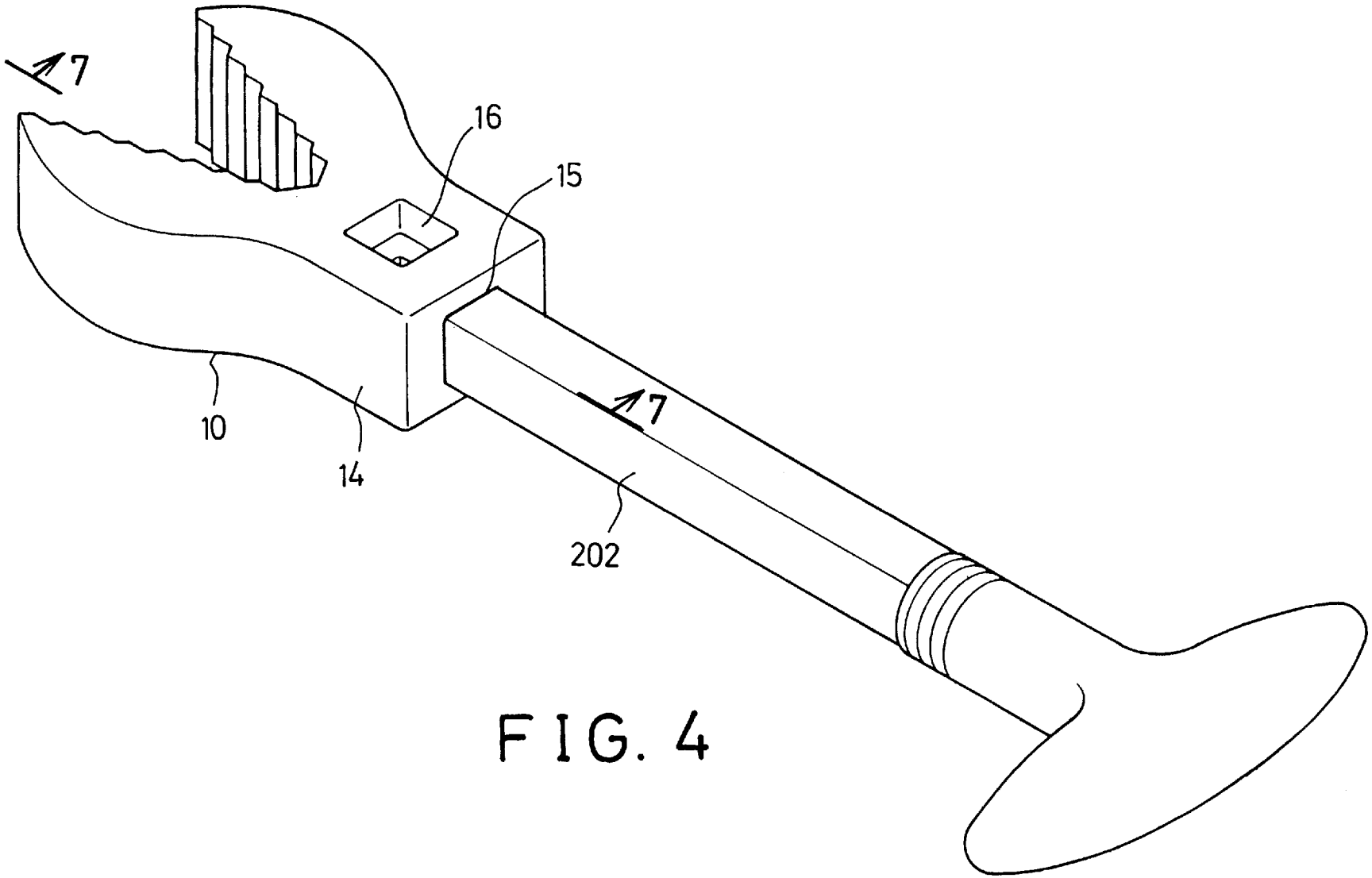
Figure 5:
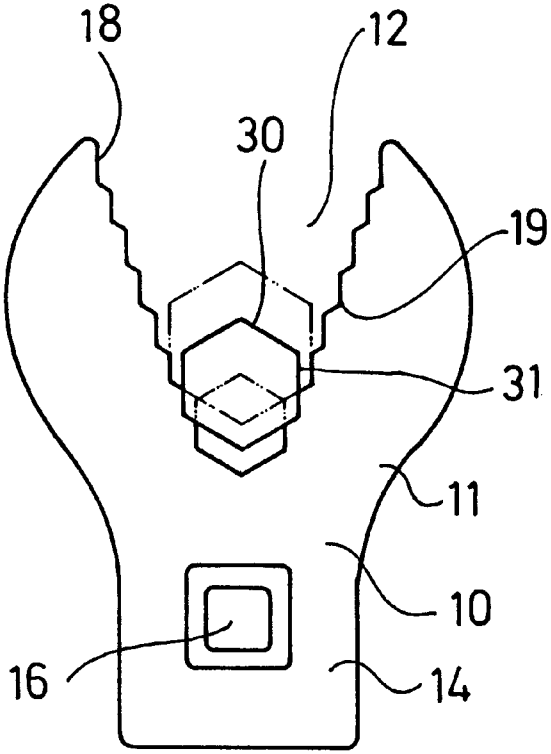
FIG. 5 is an upper view of the wrench tool, illustrating the operation of the wrench tool.

Referring to the drawings, and initially to FIGS. 1–7, a wrench tool in accordance with the present invention comprises a body 10 including a first end having a pair of jaws 11 for defining an engaging opening 12 and for engaging with the fasteners to be driven (FIG. 5). The jaws 11 include a pair of tapered surfaces 18 arranged in V-shape and having a number pairs of opposite engaging surfaces 19 for engaging with fasteners 30 of different sizes.

Figure 1:
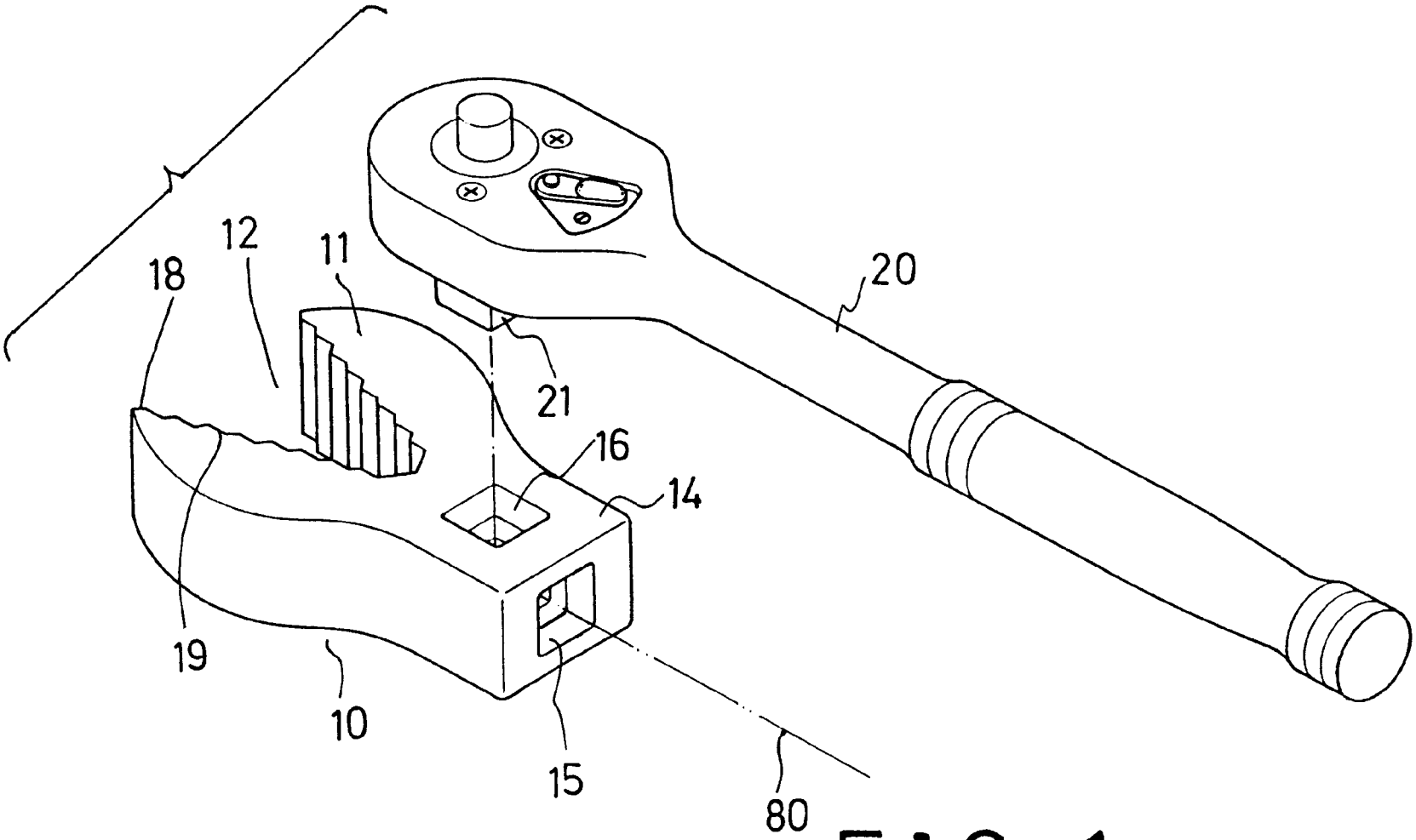
FIGS. 1 and 2 are exploded views illustrating two applications of wrench tool in accordance with the present invention.
Figure 2:
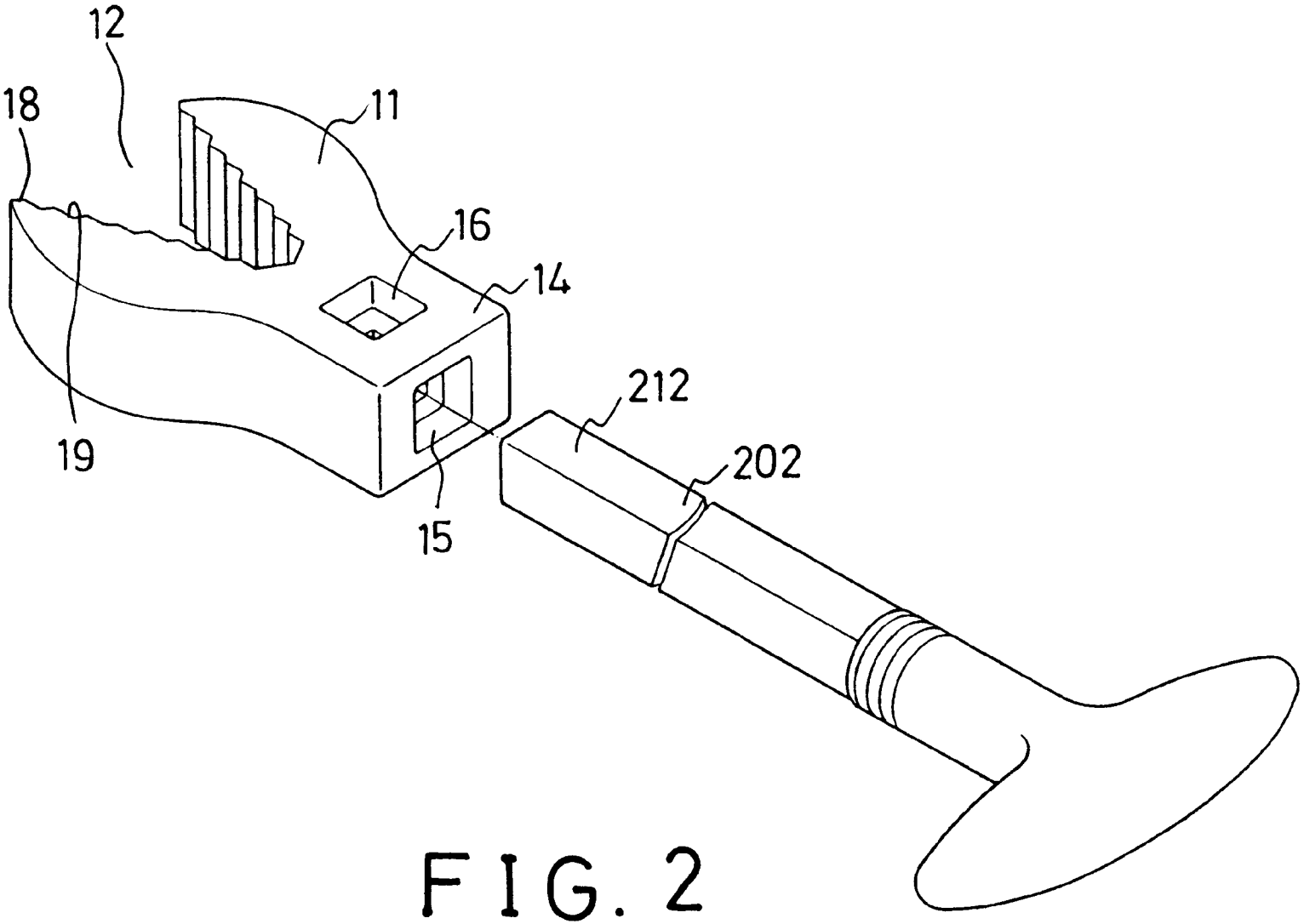
Figure 7:
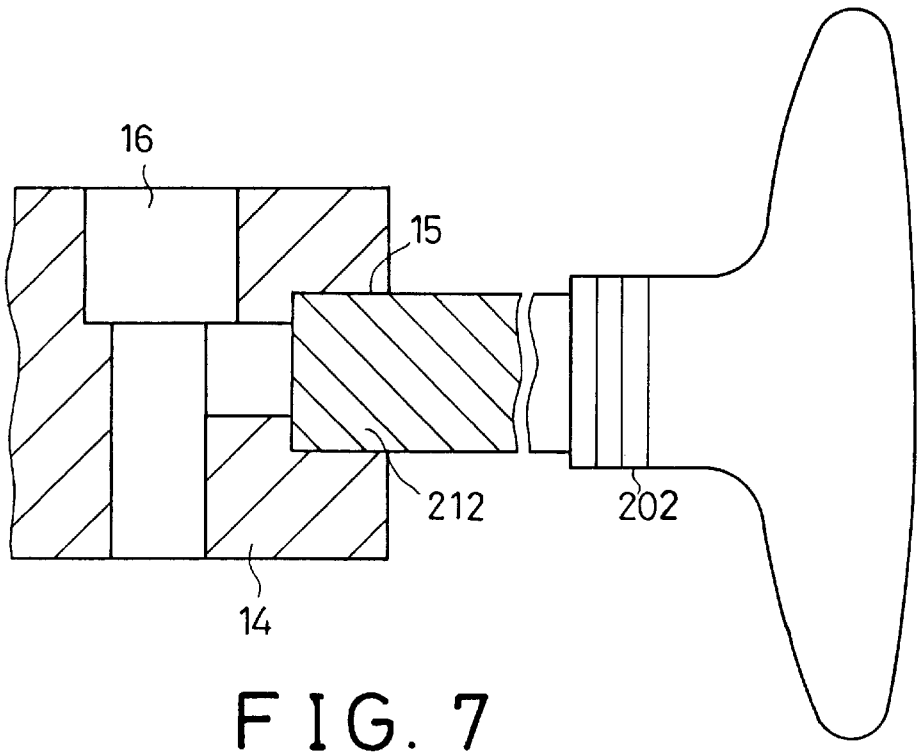
FIGS. 6 and 7 are cross sectional views taken along lines 6—6 and 7—7 of FIGS. 3 and 4 respectively.
Figure 6:
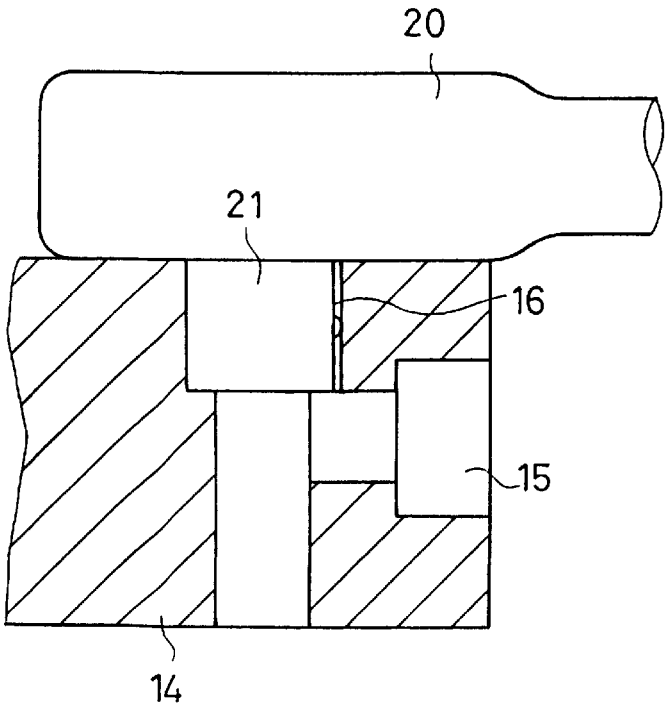

The body 10 includes a second end 14 having an orifice 15 extended along a longitudinal direction or longitudinal axis 80 of the body 10 and having another orifice 16 substantially perpendicular to the orifice 15. As shown in FIGS. 1 and 3 and 6, the orifice 16 may be provided for engaging with a driving stem 21 of a wrench 20 in which the driving stem 21 is perpendicular to the wrench body or the wrench handle 20 for allowing the wrench body 10 to be easily rotated and driven by the wrench 20. As shown in FIGS. 2, 4 and 7, the orifice 15 may be provided for engaging with a driving stem 212 of an extension 202 in which the driving stem 212 is in line with the extension 202 for allowing the wrench body 10 to be easily rotated and driven by the extension 202.

It is to be noted that the wrench body 10 may not be easily rotated by the extension 202 when the extension 202 is engaged with the orifice 16 because the extension 202 will be perpendicular to the body 10 in such case. The wrench body 10 also may not be easily rotated by the wrench 20 when the wrench 20 is engaged with the orifice 15 because the wrench handle 20 will be perpendicular to the body 10.

Figure 8:
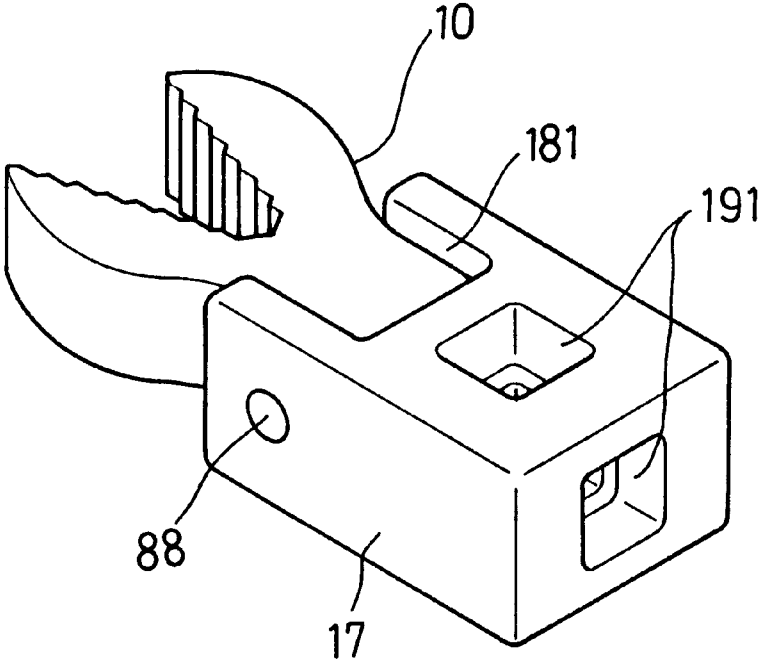
FIG. 8 is a perspective view showing another application of the wrench tool.

Referring next to FIG. 8, the wrench body 10 may include a coupler 17 pivotally coupled to the body 10 at a pivot shaft 88 and having a channel 181 for engaging with one end of the body 10. The coupler 17 includes two orifices 191 that are perpendicular to each other for engaging with wrench 20 or extension 202 and for allowing the wrench body 10 to be easily driven by different wrench tools.

Accordingly, the wrench tool includes two orifices perpendicular to each other for engaging with the other wrench or extension and for allowing the other wrench or the extension to drive the wrench tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench tool comprising:

a wrench body including a first end having an engaging opening for engaging with fasteners to be driven, and said wrench body including a longitudinal axis and including a second end having a first orifice parallel to said longitudinal axis and having a second orifice perpendicular to said first orifice, for allowing said first orifice and said second orifice to engage with different tool members, said second end of said wrench body including a coupler pivotally coupled to said first end of said wrench body at a pivot shaft, said first orifice and said second orifice being formed in said coupler for engaging with the different tool members.

2. The wrench tool according to claim 1, wherein said first end of said wrench body includes a pair of jaws for defining said engaging opening between said jaws, said jaws include a pair of tapered surface arranged in V-shape and having a plurality pairs of opposite engaging surfaces for engaging with fasteners of different sizes.

3. A wrench tool comprising:

a wrench body including a first end having an engaging opening for engaging with fasteners to be driven and including a second end, and a coupler including a longitudinal axis and including a first end pivotally coupled to said second end of said wrench body at a pivot shaft and including a second end, said second end of said coupler including a first orifice parallel to said longitudinal axis of said coupler and including a second orifice perpendicular to said first orifice, for allowing said first orifice and said second orifice to engage with different tool members.

* * * * *